United States Patent [19]

McGilvray, III

[11] Patent Number: 4,878,491

[45] Date of Patent: Nov. 7, 1989

[54] EXERCISE SNORKEL APPARATUS

[76] Inventor: Donald A. McGilvray, III, 70 Grace Ter., Pasadena, Calif. 91105

[21] Appl. No.: 248,385

[22] Filed: Sep. 23, 1988

[51] Int. Cl.[4] ..... B63C 11/16

[52] U.S. Cl. ..... 128/201.11

[58] Field of Search ..... 128/201.11, 207.11, 128/207.17

[56] References Cited

U.S. PATENT DOCUMENTS

| | | | |
|---|---|---|---|
| D. 120,372 | 5/1940 | Boothby et al. | D29/8 |
| D. 171,482 | 2/1954 | Bickel | D29/8 |
| 183,521 | 10/1876 | Weck | 128/202.15 |
| D. 215,982 | 11/1969 | Wise et al. | D29/8 |
| D. 228,476 | 9/1973 | Ferguson | D29/8 |
| 1,122,219 | 12/1914 | Read | 128/201.11 |
| 1,210,939 | 1/1917 | Hilgers | 128/201.11 |
| 1,727,202 | 9/1929 | Greer | 128/201.11 |
| 2,376,871 | 5/1945 | Fink | 128/201.19 |
| 2,581,007 | 1/1952 | Douglas | 128/201.27 |
| 2,693,180 | 11/1954 | Galeazzi | 128/201.27 |
| 2,725,876 | 12/1955 | Maille | 128/201.11 |
| 2,859,747 | 11/1958 | Stampe | 128/206.16 |
| 2,868,196 | 1/1959 | Stampe | 128/206.15 |
| 3,265,066 | 8/1966 | Katchis | 128/201.11 |
| 3,315,672 | 4/1967 | Cunningham et al. | 128/863 |
| 3,345,984 | 10/1967 | Katchis | 128/201.11 |
| 4,055,174 | 10/1977 | LeVasseur | 128/201.11 |
| 4,061,140 | 12/1977 | Saito | 128/201.11 |
| 4,230,106 | 10/1980 | Geeslin et al. | 128/201.11 |

*Primary Examiner*—David A. Wiecking
*Assistant Examiner*—Aaron J. Lewis
*Attorney, Agent, or Firm*—Thomas I. Rozsa

[57] ABSTRACT

A streamlined swimming exercise apparatus which facilitates the efficient swimming of laps in a pool by removing the requirement for the swimmer to turn his or her head to suck in air during swimming. The improvements comprise a mouthpiece designed to fit either over or into the mouth with at least one and preferably a pair of contoured tubes which are curved to generally conform to the shape of the user's face. The mouthpiece may contain one entrance passage for both tubes or may contain two separate breathing passages, a respective one of which leads to a respective tube. The two tubes may either project separately upward and open into the atmosphere on either side of the head, or alternatively, may project around the user's head and come together in a mating channel which then protrudes from a single tube at the top of the user's head. The swimmer can retain the mouthpiece in the swimmer's mouth and breath normally while holding his or her head forward with the face into the water for conventional Australian Crawl stroke.

18 Claims, 2 Drawing Sheets

Fig. 7.
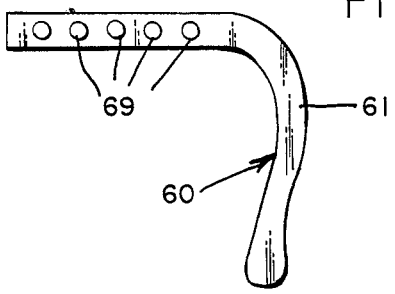
Fig. 8.
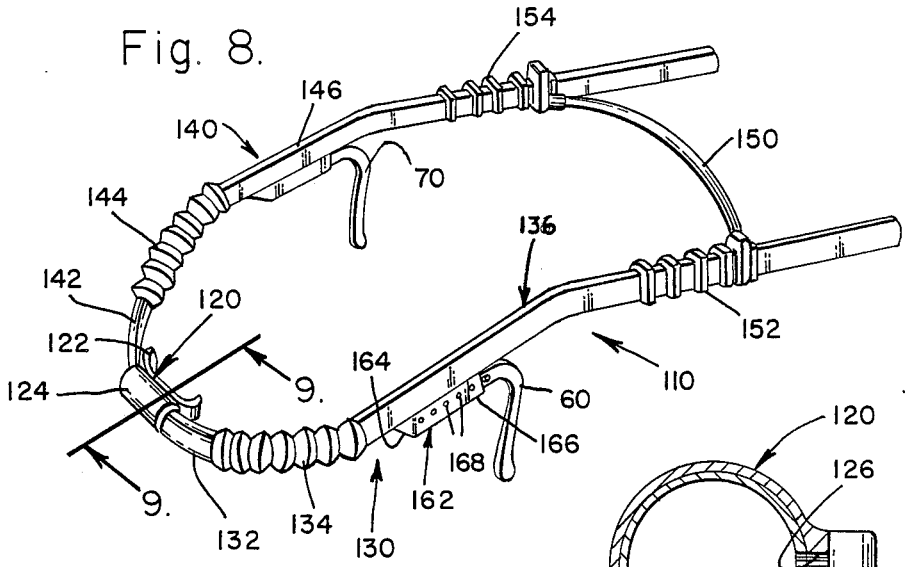
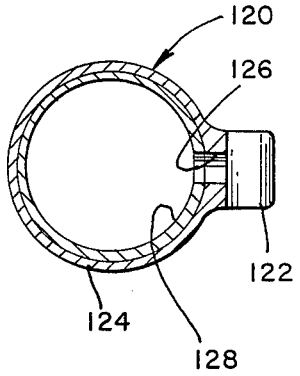
Fig. 9.
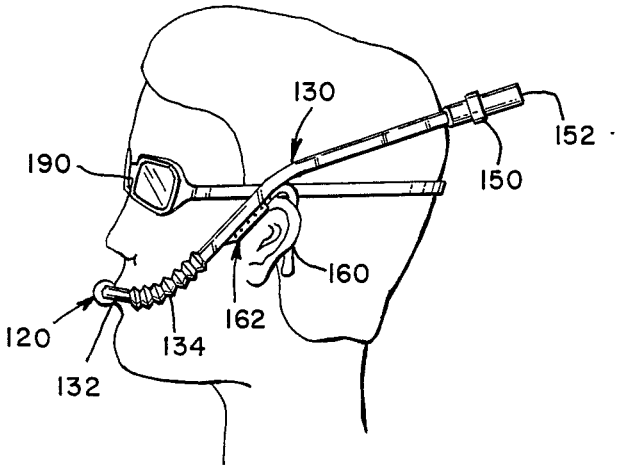
Fig. 10.

EXERCISE SNORKEL APPARATUS

BACKGROUND OF THE INVENTION

1. Field of the Invention

The present invention relates to the field of swimming exercise apparatus which are used to aid an individual in exercise swimming. The device relates to swimming aids which permit an individual performing exercise swimming laps in a body of water such as a pool to concentrate on his or her swimming and relieves the individual of the requirement of constantly turning his or her head to expose an open mouth to the air in order to breath. The present invention concerns exercise apparatus which aid in the ease and efficiency by which swimming may be performed during the swimming of exercise laps in a pool.

2. Description of the Prior Art

A conventional snorkel has a mouthpiece which is cumbersome and a tube which extends beyond the user's head, to thereby permit the user to perform shallow dives in order to see beneath the surface of the water. While a conventional snorkel is useful for shallow dives and for short distance swimming to enable the user to breathe beneath the surface of the water, its cumbersome design and loose fitting construction wherein the snorkel tube merely extends loosely upward adjacent one side of the user's head, makes a conventional snorkel impractical for constant steady swimming of laps using a conventional Australian Crawl swimming stroke. The cumbersome design creates too much drag in the water and further does not facilitate constant swimming with the mouthpiece retained in the user's mouth.

The following patents illustrate various types of swimming assistance apparatus known in the prior art:

1. U.S. Pat. No. 4,055,174 issued to LeVasseur in 1977 for "Swimming System". This patent discloses an elaborate swimming suit which includes a mouthpiece with tubes leading around the wearer's neck. In the preferred embodiment such as shown in FIGS. 14 and 15, two snorkel tubes are employed and the snorkel tubes 104 join at the mouthpiece 106 and at the blow hole 56. A major difference here is that the snorkel tubes project around and behind the wearer's neck and would not be practical for the purposes of exercise swimming since the tubes would soon fill up with water.

2. U.S. Pat. No. 2,581,007 issued to Douglas et al. in 1952 for "Swimming Helmet". In this patent, the swimming helmet also has tubes which extend along the side of the neck and could easily fill up with water.

3. U.S. Pat. No. 183,521 issued to Weck in 1876 for "Life Preserving And Swimming Suits". In this invention, a mask C' covers the face and a pair of very cumbersome flexible pipes d' extend rearwardly from the mask and at least one attaches to a drum D. The device is extremely cumbersome and impractical.

4. U.S. Pat. No. 2,693,180 issued to Galeazzi in 1954 for "Exhalation Valve For Diving Suits". This patent merely discloses a specialized valve to be used with diving suits.

The following patents illustrate various types of masks having tubing attached thereto:

1. U.S. Pat. No. 2,376,871 issued to Fink in 1945 for "Respirator Mask". This patent also discloses a mask (rather than a mouthpiece) with tubes leading from the mask to a single passageway. A key difference is that air is going into the mask (from a supply of oxygen) and the structure is impractical for swimming.

2. U.S. Pat. No. 3,315,672 issued to Cunningham et al. in 1967 for "Surgical Mask". This patent discloses a shield 12 molded to the usual contour of the face, and to which is attached an air exhaust conduit 16.

3. U.S. Pat. No.2,868,196 issued to Stampe in 1959 for "Dust Filter Mask". This patent discloses a mask which has a filter tubing attached to it.

4. U.S. Pat. No. 2,859,747 issued to Stampe in 1954 for "Dust Respirator". This patent discloses a mask which has filter tubing attached to it.

5. U.S. Design Pat. No. Des. 228,476 issued to Ferguson et al. in 1973 for "Combined Oxygen Mask And Holder". This patent discloses a mouthpiece with tubing attached to a source of oxygen.

6. U.S. Design Pat. No. Des. 215,982 issued to Abraham et al. in 1969 for "Disposable Anesthetist'Kit". This patent discloses a mask with tubing attached thereto which also extends to a source of gas.

7. U.S. Design Pat. No. Des. 171,482 issued to Bickel in 1953 for "Respirator". This patent discloses a respirator with short tube passages extending sidewardly from the breathing portion.

8. U.S. Pat. Design Pat. Des. 120,372 issued to Boothby et al. in 1939 for "Nasal Mask". This patent discloses a mask with a pair of downwardly extending passageways and which then come together into a single passageway.

Therefore, there are no devices known in the prior art which facilitate streamlined and efficient connection from a mouthpiece to a breathing tube or tubes for efficient use by a swimmer during swimming exercise laps. The prior art devices are also cumbersome and require use with either a mask or a full swimming suit. A significant need exists for an efficient device which can be used to facilitate the swimming laps in a pool.

SUMMARY OF THE PRESENT INVENTION

The present invention is a streamlined swimming exercise apparatus which facilitates the efficient swimming of laps in a pool by removing the requirement for the swimmer to turn his or her head to suck in air during swimming. The improvements comprise a mouthpiece designed to fit either over or into the mouth with at least one and preferably a pair of contoured tubes which are curved to generally conform to the shape of the user's face. The mouthpiece may contain one entrance passage for both tubes or may contain two separate breathing passages, a respective one of which leads to a respective tube. The two tubes may either project separately upward and open into the atmosphere on either side of the head, or alternatively, may project around the user's head and come together in a mating channel which then protrudes from a single tube at the top of the user's head. The swimmer can retain the mouthpiece in the swimmer's mouth and breath normally while holding his or her head forward with the face into the water for a conventional Australian Crawl stroke. The streamlined design does not present significant drag in the water and the upward and backward extension of the tubes prevents water from entering the tubes. The user can remain with his or her face under water and does not need to constantly turn his or her head to suck in air. In addition, the possibility of accidentally sucking in water is also eliminated.

It has been discovered, according to the present invention, that if a mouthpiece is designed to fit into the user's mouth and contains within it at least one chamber which extends to at least one hollow breathing tube which is designed to conform to the shape of the side of the user's face and head and which hollow tube extends upwardly and backwardly behind the user's head and just above the user's ears. The device can be used to enable the person to breath continuously while swimming with his or her face in the water and eliminates the necessity of turning the head to expose the swimmer's mouth to the air above the water.

It has also been discovered, according to the present invention, that a construction of a flexible portion of breathing tubing in the area of the user's face permits the tubing to be precisely contoured to the user's face, thereby creating an apparatus which is more streamlined for the particular user and significantly reduces drag in the water.

It has further been discovered, according to the present invention that the attachment of an adjustable temple comparable to the temples on a pair of eyeglasses to a portion of the hollow breathing tubes permits the tubes to be worn on the ears and provides a more secure fit to assure stability while the swimmer is moving through the water.

It has additionally been discovered, according to the present invention, that the breathing tubes which extend above the user's ears and upwardly and backwardly behind the user's head significantly reduces the accidental ingestion of water by the swimmer.

It has further been discovered, according to the present invention, that the attachment of goggles to the breathing tubes assures a secure fit to prevent the breathing tube from falling of during swimming.

It has also been discovered, according to the present invention, that the design of the breathing tubes may either extend straight back behind the ears so that the two breathing tubes do not come together and are separated by a strap which fits around the back of the user's head, or alternatively can be configured to come together and thereafter extend into one large tube extending directly behind the center of the user's head.

It is therefore an object of the present invention to provide a swimming exercise apparatus which enables a swimmer to keep his or her face in the water while swimming and eliminate the necessity of turning his or her head to expose the mouth in order to breathe and suck in air.

It is another object of the present invention to provide a swimming exercise apparatus which significantly reduces the possibility of the swimmer ingesting water while swimming.

It is a further object of the present invention to provide a breathing apparatus which is streamlined and contoured to the swimmer's face so that the swimmer can efficiently swim through the water while the breathing device provides a minimum of drag and resistance and does not interferes with the swimming process.

It is yet another object of the present invention to provide a breathing apparatus which can be secured to the swimmer such as behind the swimmer's ears or by means of goggles to the front of the swimmer's face to thereby assure that the apparatus will not come loose during swimming.

It is a further object of the present invention to provide a simple apparatus with no moving parts to thereby reduce the possibility of product failure and increase the likelihood of efficient operation.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 7 is a side elevational view of the partial temple portion of the present invention.

FIG. 8 is a perspective view of an alternative embodiment of the present invention.

FIG. 9 is a cross-sectional view taken along line 9—9 of FIG. 8.

FIG. 10 is a side elevational view of the alternative embodiment of the present invention as worn by a swimmer.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
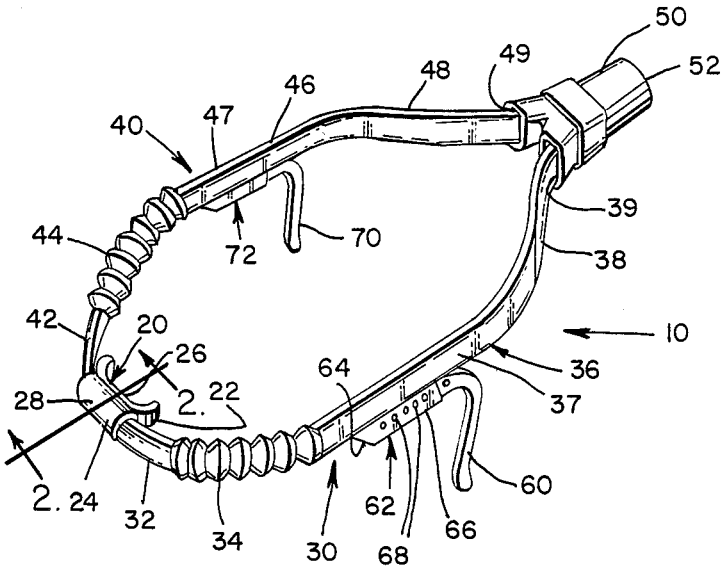
FIG. 1 is a perspective view of one embodiment of the present invention.
Figure 2:
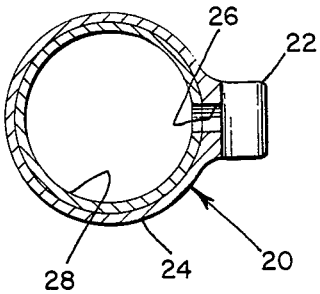
FIG. 2 is a cross-sectional view taken along line 2—2 of FIG. 1.

Referring to FIGS. 1 and 2, there is shown at 10 a perspective view of one embodiment of the present invention exercise snorkel apparatus. At the front center of the exercise snorkel apparatus 10 is a mouthpiece 20 which further comprises a gripping member 22 which is inserted into the user's mouth and mouthpiece tube 24 to which the gripping member 22 is attached. The gripping member 22 has a central opening 26 which opens into a hollow chamber 28 within the mouthpiece tube 24.

Extending from the mouthpiece tube 24 are a pair of hollow breathing tubes. First hollow breathing tube 30 comprises a hollow insert section 32 which extends into one side of the mouthpiece tube 24 and is in fluid communication with chamber 28, a hollow flexible bellows section 34 which extends from the other side of the insert section 32, and a hollow elongated section 36 which in turn has a straight portion 37, a curved potion 38 and a mating chamber portion 39. Second hollow breathing tube 40 is a mirror image of first hollow breathing tube 30. Second hollow breathing tube 40 comprises a hollow insert section 42 which extends into the opposite side of the mouthpiece tube 24 and is in fluid communication with chamber 28, a hollow flexible bellows section 44 which extends from the other side of the insert section 42, and a hollow elongated section 46 which in turn has a straight portion 47, a curved portion 48 and a mating chamber portion 49. The respective hollow insert sections 32 and 42 extend away from each other and join their respective hollow flexible bellow sections 34 and 44 which extend along oppositely disposed arcuate routes. The purpose of the hollow flexible sections 34 and 44 is to "mold" the exercise snorkel apparatus 10 to conform to the exact curvature of the wearer's face, therefore assuring a smooth streamlined fit for each individual user. The respective elongated straight portions 37 and 47 are designed to be aligned with the side of the wearer's head and preferably extend over the wearer's ears. The respective arcuate portions 38 and 48 are designed to be worn around the back of the wearer's head behind the ears and extending to the top of the wearer's head. A joining hollow collar 50 joins respective curved portions 39 and 49 such that they lie adjacent each other and extend out the back opening 52 of joining hollow collar 50.

Figure 3:
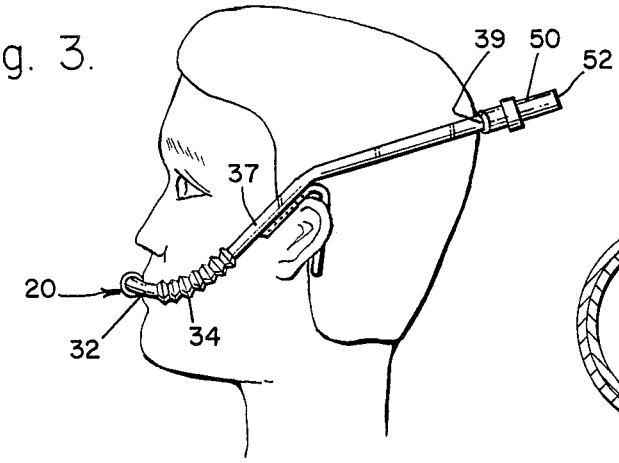
FIG. 3 is a side elevational view of the present invention as worn by a swimmer.

The exercise snorkel apparatus in use is shown in FIG. 3. The user places the gripping member 22 in his mouth such that the gripping member 22 is held between the user's upper and lower teeth. In this way, there is a clear passage between the user's mouth and lungs through opening 26 and into the chamber 28 of the mouthpiece tube 24. The pair of hollow insert sections 32 and 42 extend around the wearer's mouth, as shown in FIG. 3. The pair of hollow flexible bellows sections 34 and 44 are hand formed to conform to the curvature of the wearer's face and extend around the side of the wearer's face from the tip of the mouth, around the cheek and up a side of the face, as shown in FIG. 3. The pair of hollow straight portions 37 and 47 extend along the side of the head over each respective ear and behind the ear. The curved portions 39 and 49 extend beyond the wearer's ears and around the back of the wearer's head until they come together behind the wearer's head where they are joined by the hollow joining collar 50. In this way, the exercise snorkel apparatus 10 provides a streamlined and snug fit around the wearer's head and provides a minimum of drag and resistance in the water. The wearer can keep his face down and swim the Australian Crawl without having to turn his head to expose his mouth to breathe and suck air. Since the opening of the hollow joining collar 50 extends beyond the wearer's head and in an upward direction, the opening is well above the water line and very little water, if any, will enter the breathing passageway from the wearer's mouth through the inside of both tubes. In this way, the wearer can efficiently and continuously breathe in fresh air while swimming.

Figure 4:
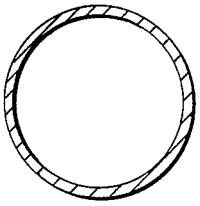
FIG. 4 is a cross-sectional view of a portion of the breathing tube of the present invention, showing circular cross-section.
Figure 5:
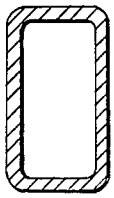
FIG. 5 is a cross-sectional view of a portion of the breathing tube of the present invention, showing a rectangular cross-section.
Figure 6:
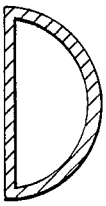
FIG. 6 is a cross-sectional view of a portion of the breathing tube of the present invention, showing a "D" shaped cross-section.

Three alternative embodiments for the cross-section of the two hollow breathing tubes 30 and 40 is shown in FIGS. 4, 5 and 6. In one embodiment shown in FIG. 4, the various sections may be generally circular in cross-section. Alternatively, as shown in FIG. 5, they may be rectangular in cross-section. Or, as shown in FIG. 6, they may be generally "D" shaped in cross-section with the straight portion of the "D" facing inwardly against the wearer's face. The "D" cross-sectional shape is the preferred embodiment since it is believed that this will provide the closest streamlined fit against the wearer's face. However, other cross-sections such as the circular or generally rectangular cross-sections are also within the spirit and scope of the present invention.

Another optional feature for the present invention exercise snorkel apparatus 10 is a pair of temples which are attached to the two breathing tubes 30 and 40 such that they can fit above the wearer's ears like a pair of glasses. This provides extra support for the exercise snorkel apparatus 10 on the wearer. The pair of temples 60 and 70 may be fixed to a portion of the tubes, preferably at the location of the hollow elongated sections 37 and 47 respectively. Alternatively, in an improved modification, the temples 60 and 70 may instead be movably affixed to adjustable mounting means so that the locations of the temples may be adjusted relative to the individual wearer's ears. Mounting means 62 can be permanently affixed beneath elongated portion 37 of breathing tube 30. Mounting means 62 contains a hollow chamber 64 into which temple 60 is inserted. A wall 66 of mounting means 62 contains a multiplicity of openings 68. The temple 60 contains a multiplicity of mating pins or tongues 69, as best illustrated in FIG. 7. The temple 60 is inserted into chamber 64 of mounting means 62 and a respective pin or pins 69 are aligned with respective holes 68 so that the distance from the wearer's mouth to the curved section 61 which fits around the wearer's ears is adjusted to the individual's head. It will be appreciated that the openings 68 and pins 69 are just one of many adjustment means by which the temple can be adjusted to the individual wearer. It will also be appreciated that the holes can be in the temple and the openings or tongues on the inside wall of the mounting means. Similarly, mounting means 72 is fit beneath hollow elongated portion 47 of breathing tube 40 and contains an inner chamber and a series of adjustment holes in its wall. Temple 70 also contains a multiplicity of adjustment pins or tongues on its surface.

An alternative embodiment of the present invention exercise snorkel apparatus 110 is shown in FIGS. 8 through 10. Referring to FIGS. 8 and 9, there is shown at 110 a perspective view of an alternative embodiment of the present invention exercise snorkel apparatus. At the front center of the exercise snorkel apparatus 110 is a mouthpiece 120 which further comprises a gripping member 122 which is inserted into the user's mouth and a mouthpiece tube 124 to which the gripping member 122 is attached. The gripping member 122 has a central opening 126 which opens into a hollow chamber 128 within the mouthpiece tube 124.

Extending from the mouthpiece tube 124 are a pair of hollow breathing tubes. First hollow breathing tube 130 comprises a hollow insert section 132 which extends into one side of the mouthpiece tube 124 and in fluid communication with chamber 128, a hollow flexible bellows section 134 which extends from the other side of the insert section 132, and a hollow elongated section 136. Unlike the first embodiment 10 in which the elongated section 36 has several portions, in the alternative embodiment 110 the elongated section 136 is straight and extends straight backward above and to one side of the wearer's head. It may consist of more than one straight section which are at slight angles relative to one another for a more precise fit over the wearer's ears. Second hollow breathing tube 140 is a mirror image of first hollow breathing tube 130. Second hollow breathing tube 140 comprises a hollow insert section 142 which extends into the opposite side of the mouthpiece tube 124 an in fluid communication with chamber 128, a hollow flexible bellows section 144 which extends from the other side of the insert section 142, and a hollow elongated section 146. Unlike the first embodiment 10 in which the elongated section 46 has several portion, in the alternative embodiment 110 the elongated section 146 is straight and extends straight backward above and to one side of the wearer's head. It may consist of more than one straight section which are at slight angles relative to one another for a more precise fit over the wearer's ears. As with the first embodiment, the purpose of the hollow flexible bellow sections 134 and 144 is to "mold" the exercise snorkel apparatus 110 to conform to the exact curvature of the wearer's face, therefore assuring a smooth streamlined fit for each individual user. The respective elongated straight sections 136 and 146 are designed to be aligned with the side of the wearer's head and preferably extend over the wearer's ears and straight back behind the wearer's head. The two straight sections 136 and 146 are joined by a flexible connecting member 150 which can be a flexible cord or strap which has adjustment means 152 and 154 on sections 136 and 146 respectively so that the cord 150 can be adjusted for a tight fit around the back of the wearer's head.

The alternative embodiment 110 for the exercise snorkel apparatus in use is shown in FIG. 10. The user places the gripping member 122 in his mouth such that the gripping member 122 is held between the user's upper and lower teeth. In this way, there is a clear passage between the user's mouth and lungs through opening 126 and into the chamber 128 of the mouthpiece tube 124. The pair of hollow insert sections 132 and 142 extend around the wearer's mouth, as shown in FIG. 10. The pair of hollow flexible bellows sections 134 and 144 are hand formed to conform to the curvature of the wearer's face and extend around the side of the wearer's face from the tip of the mouth, around the cheek and up a side of the face, as shown in FIG. 10. The pair of hollow straight sections 136 and 146 extend along the side of the head over each respective ear and behind the ear, and upwardly and backward above and behind the head. The adjustment strap cord 150 is tightened to assure a firm fit. In this way, the exercise snorkel apparatus 10 provides a streamlined and snug fit around the wearer's head and provides a minimum of drag and resistance in the water. The wearer can keep his face down and swim the Australian Crawl without having to turn his head to expose his mouth to breathe and suck in air. Since the openings of both hollow breathing tubes 130 and 140 extend beyond the wearer's head and in an upward direction, the openings are well above the water line and very little water, if any, will enter the breathing passageway from the wearer's mouth through the inside of both tubes. In this way, the wearer can efficiently and continuously breathe in fresh air while swimming.

The three alternative embodiments for the cross-section of the hollow breathing tubes illustrated in FIGS. 4 through 6 also apply to the two hollow breathing tubes 130 and 140 of the alternative embodiment 110 of the exercise snorkel apparatus. In one embodiment shown in FIG. 4, the various sections may be generally circular in cross-section. Alternatively, as shown in FIG. 5, they may be rectangular in cross-section. Or, as shown in FIG. 6, they may be generally "D" shaped in cross-section with the straight portion of the "D " facing inwardly against the wearer's face. The "D" cross-sectional shape is the preferred embodiment since it is believed that this will provide the closest streamlined fit against the wearer's face. However, other cross-sections such as the circular or generally rectangular cross-sections are also within the spirit and scope of the present invention.

As with the first embodiment, another optional feature for the present invention exercise snorkel apparatus 110 is a pair of temples which are attached to the two breathing tubes 130 and 140 such that they can fit above the wearer's ears like a pair of glasses. This provides extra support for the exercise snorkel apparatus 110 on the wearer. The pair of temples 160 and 170 may be fixed to a portion of the tubes, preferably at the location of the hollow elongated sections 136 and 146 adjacent to the wearer's ears. Alternatively, in an improved modification, the temples 160 and 170 may instead be movably affixed to adjustable mounting means so that the location of the temples may be adjusted relative to the individual wearer's ears. Mounting means 162 can be permanently affixed beneath elongated section 136 of breathing tube 130. Mounting means 162 contains hollow chamber 164 into which temple 160 is inserted. A wall 166 of mounting means 162 contains a multiplicity of openings 168. The temple 160 contains a multiplicity of mating pins or tongues 169, as best illustrated in FIG. 7. The temple 160 is inserted into chamber 164 of mounting means 162 and a respective pin or pins 169 are aligned with respective holes 168 so that the distance from the wearer's mouth to the curved section 161 which fits around the wearer's ears is adjusted to the individual's head. It will be appreciated that the openings 168 and pins 169 are just one of many adjustment means by which the temple can be adjusted to the individual wearer. It will also be appreciated that the holes can be in the temple and the pins or tongues on the inside wall of the mounting means. Similarly, mounting means 172 is fit beneath hollow elongated section 146 of breathing tube 140 and contains an inner chamber and a series of adjustment holes in its wall. Temple 170 also contains a multiplicity of adjustment pins or tongues on its surface.

Another alternative feature which adds extra security for the fit on the alternative embodiment 110 is to attach the straps from goggles 190 to the respective elongated hollow sections 130 and 140, as also illustrated in FIG. 10. The goggles attachment assures a tighter fit of the exercise snorkel apparatus to the swimmer. While it makes most sense for this attachment in the alternative embodiment 110 where the two breathing tubes 130 and 140 are spaced apart since there is more looseness in this embodiment, the goggles can also be attached to the breathing tubes 130 and 140 of the first embodiment 10.

Either embodiment of the exercise snorkel apparatus can be made of any multiplicity of materials. For example, the exercise snorkel apparatus can be made of plastic or from flexible rubber.

Of course the invention is not intended to be restricted to any particular form or arrangement, or any specific embodiment discloses herein, or any specific use, since the same may be modified in various particular or relations without departing from the spirit of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms.

However, such detailed description is not intended in any way to limit the broad features or principles of the invention, or the scope of patent monopoly to be granted.

What is claimed is:

1. An exercise snorkel apparatus comprising:

a. a mouthpiece having a gripping member, an internal chamber and an opening through the gripping member extending into the internal chamber;

b. a first hollow breathing tube connected to one side of the mouthpiece and in fluid communication with the internal chamber of the mouthpiece;

c. said first hollow breathing tube further comprising a hollow insert section which extends into one side of the mouthpiece, a hollow flexible bellows section which extends from the other side of the hollow insert section, and a hollow elongated section extending from the other side of the hollow flexible bellows section and further comprising a straight portion, an arcuate portion and a mating chamber portion;

d. a second hollow breathing tube connected to the opposite side of the mouthpiece and in fluid communication with the internal chamber of the mouthpiece;

e. said second hollow breathing tube being a mirror image of the first hollow breathing tube, and further comprising a hollow insert section which extends into one side of the mouthpiece, a hollow flexible bellows section which extends from the other side of the hollow insert section, and a hollow elongated section extending from the other side of the hollow flexible bellows section and further comprising a straight portion, an arcuate portion and a mating chamber portion;

f. the respective hollow insert sections extending away from each other and joining their respective hollow flexible bellows sections which extend along oppositely disposed arcuate routes; and g. the respective arcuate portions of the respective hollow elongated sections extending along a joining arcuate path such that their remote ends lie adjacent each other and are joined together by a joining hollow collar such that the back opening of the breathing tubes extend out of the back opening of the joining hollow collar;

h. whereby the exercise snorkel apparatus may be held between the wearer's teeth and the exercise snorkel apparatus is positioned on the wearer's head such that the respective hollow flexible bellow sections are aligned around the side of the wearer's face, the straight portion of a respective one of the elongated hollow sections rests over a respective one of the wearer's ears, and the respective joined arcuate portions and joining hollow collar extend behind the wearer's head the exercise snorkle apparatus further including a first adjustable mounting means affixed beneath the straight portion of the first hollow breathing tube;

a the first adjustable mounting means further comprising a hollow chamber and a wall having a multiplicity of mating members therein;

a first adjustable temple having a multiplicity of mating members thereon and insertable into the chamber of the first adjustable mounting means such that the temple can be adjustable to fit into one of the wearer's ears;

a second adjustable mounting means affixed beneath the straight portion of the second hallow breathing tube;

the second adjustable mounting means further comprising a hollow chamber and a wall having a multiplicity of mating members therein and;

a second adjustable temple having a multiplicity of mating members thereon and insertable into the chamber of the second adjustable mounting means such that the temple can be adjusted to fit the wearer's other ear.

2. An exercise snorkel apparatus in accordance with claim 1 wherein the cross-section of the first hollow breathing tube is circular and the cross-section of the second hollow breathing tube is circular.

3. An exercise snorkel apparatus in accordance with claim 1 wherein the cross-section of the first hollow breathing tube is generally rectangular and the cross-section of the second hollow breathing tube is generally rectangular.

4. An exercise snorkel apparatus in accordance with claim 1 wherein the cross-section of the first hollow breathing tube is "D" shaped and the cross-section of the second hollow breathing tube is "D" shaped, with the respective vertical portions of the "D" facing each other.

5. An exercise snorkel apparatus in accordance with claim 1 further comprising:

a. a first temple located beneath the first hollow breathing tube and aligned with one of the wearer's ears; and b. a second temple located beneath the second hollow breathing tube and aligned with the wearer's other ear.

6. The invention in accordance with claim 1 wherein the multiplicity of mating members for the first and second adjustable mounting means is a multiplicity of holes in the wall of each adjustable mounting means and the mating members on each of the temples is a multiplicity of pins protruding from the side of each of the temples.

7. An exercise snorkel apparatus in accordance with claim 1 wherein the exercise snorkel apparatus is made of plastic.

8. An exercise snorkel apparatus in accordance with claim 1 wherein the exercise snorkel apparatus is made of flexible rubber.

9. An exercise snorkel apparatus comprising:

a. a mouthpiece having a gripping member, an internal chamber and an opening through the gripping member extending into the internal chamber;

b. a first hollow breathing tube connected to one side of the mouthpiece and in fluid communication with the internal chamber of the mouthpiece;

c. said first hollow breathing tube further comprising a hollow insert section which extends into one side of the mouthpiece, a hollow flexible bellows section which extends from the other side of the hollow insert section, and a hollow elongated section extending from the other side of the hollow flexible bellows section;

d. a second hollow breathing tube connected to the opposite side of the mouthpiece and in fluid communication with the internal chamber of the mouthpiece;

e. said second hollow breathing tube being a mirror image of the first hollow breathing tube, and further comprising a hollow insert section which extends into one side of the mouthpiece, a hollow flexible bellows section which extends from the other side of the hollow insert section, and a hollow elongated section extending from the other side of the hollow flexible bellows section;

f. the respective hollow insert sections extending away from each other and joining their respective hollow flexible bellows sections which extend along oppositely disposed arcuate routes; and g. the respective hollow elongated sections extending in a generally parallel spaced apart relationship and flexibly connected by a flexible connecting member.

h. whereby the exercise snorkel apparatus may be held between a wearer's teeth and the exercise snorkel apparatus is positioned on the wearer's head such that the respective hollow flexible bellows sections are aligned around the side of the wearer's face, that hollow elongated sections extend upward and backward such that the opening of each section is behind and to one side of the wearer's head and such that a respective one of the elongated hollow sections rests over a respective one of the wearer's ears, and the flexible connecting member rests behind the wearer's head, the exercise snorkel apparatus further including a first adjustable mounting means affixed beneath the first elongated hollow section of the first hollow breathing tube;

the first adjustable mounting means further comprising a hollow chamber and a wall having a multiplicity of mating members therein;

a first adjustable temple having a multiplicity of mating members thereon and insertable into the chamber of the first adjustable mounting means such that the temple can be adjusted to fit into one of the wearer's ears;

a second adjustable mounting means affixed o beneath the second elongated hollow section of the second hollow breathing tube;

the second adjustable mounting means further comprising a hollow chamber and a wall having a multiplicity of mating members therein; and a second adjustable temple having a multiplicity of mating members thereon and insertable into the chamber of the chamber adjustable mounting means such that the temple can be adjusted to fit onto the wearer's other ear.

10. An exercise snorkel apparatus in accordance with claim 9 wherein said flexible connecting member is a cord attached to the first elongated hollow section and to the second elongated hollow section.

11. An exercise snorkel apparatus in accordance with claim 9 wherein the cross-section of the first hollow breathing tube is circular and the cross-section of the second hollow breathing tube is circular.

12. An exercise snorkel apparatus in accordance with claim 9 wherein the cross-section of the first hollow breathing tube is generally rectangular and the cross-section of the second hollow breathing tube is generally rectangular.

13. An exercise snorkel apparatus in accordance with claim 9 wherein the cross-section of the first hollow breathing tube is "D" shaped and the cross-section of the second hollow breathing tube is "D" shaped, with the respective vertical portions of the "D" facing each other.

14. An exercise snorkel apparatus in accordance with claim 9 further comprising:

a. a first temple located beneath the first hollow breathing tube and aligned with one of the wearer's ears; and b. a second temple located beneath the second hollow breathing tube and aligned with the wearer's other ear.

15. The invention in accordance with claim 9 wherein the multiplicity of mating members for the first and second adjustable mounting means is a multiplicity of holes in the wall of each adjustable mounting means and the mating members on each of the temples is a multiplicity of pins protruding from the side of each of the temples.

16. An exercise snorkel apparatus in accordance with claim 9 wherein the exercise snorkel apparatus is made of plastic.

17. An exercise snorkel apparatus in accordance with claim 9 wherein the exercise snorkel apparatus is made of flexible rubber.

18. An exercise snorkel apparatus in accordance with claim 9 further comprising goggles attached to the elongated section of the first breathing tube and attached to the elongated section of the second breathing tube.

* * * * *